United States Patent [19]

Hilgarth

[11] Patent Number: 4,793,076

[45] Date of Patent: Dec. 27, 1988

[54] SKIING BOOT AND PROCESS FOR ITS MANUFACTURE

[75] Inventor: Kurt Hilgarth, Graz, Austria

[73] Assignee: Skischuhfabrik Dynafit Gesellschaft m.b.H., Graz, Austria

[21] Appl. No.: 59,948

[22] Filed: Jun. 9, 1987

[30] Foreign Application Priority Data

Jul. 24, 1986 [AT] Austria ..... A2007/86

[51] Int. Cl.[4] ..... H43B 5/04

[52] U.S. Cl. ..... 36/117; 36/120

[58] Field of Search ..... 36/117–121, 36/50, 54, 45; 12/142 R, 142 P

[56] References Cited

U.S. PATENT DOCUMENTS

| | | | |
|---|---|---|---|
| 3,609,887 | 10/1971 | Hickmann et al. | 36/121 |
| 3,775,866 | 12/1973 | Marker | 36/117 |
| 3,975,840 | 8/1976 | Juzenko | 36/117 |
| 3,988,842 | 11/1976 | Rathmell | 36/121 |
| 4,562,652 | 1/1986 | Hensler | 36/45 X |
| 4,602,443 | 7/1986 | Spademan | 36/120 |
| 4,615,128 | 10/1986 | Borsoi et al. | 36/120 |
| 4,658,517 | 4/1987 | Miyoshi et al. | 36/117 |
| 4,677,769 | 7/1987 | Ahmad et al. | 36/117 |
| 4,685,226 | 8/1987 | Olivieri et al. | 36/120 |

FOREIGN PATENT DOCUMENTS

| | | | |
|---|---|---|---|
| 0053340 | 6/1982 | European Pat. Off. | 36/120 |
| 0167765 | 1/1986 | European Pat. Off. | 36/117 |
| 3336063 | 4/1984 | Fed. Rep. of Germany | 36/117 |

*Primary Examiner*—James K. Chi

*Attorney, Agent, or Firm*—Fleit, Jacobson, Cohn & Price

[57] ABSTRACT

Skiing boot with a shell and a shaft comprising a cover for entering the boot from behind and a collar forming the front portion of the shaft and extending right into the upper portion of the shell. The collar jointly with an on- following region of the upper portion of the shell forms a structural unit which is adjustable in the direction of motion in relation to the upper tip portion of the shell.

8 Claims, 2 Drawing Sheets

SKIING BOOT AND PROCESS FOR ITS MANUFACTURE

BACKGROUND OF THE INVENTION

The invention relates to a skiing boot comprising a shell and a shaft which is composed of a cover adapted for entering the boot from behind and a collar forming the front portion of the shaft, the collar extending into the upper region of the shell and forming an integral structural unit with a portion of the shell upper region which follows onto this collar, that unit being adjustable in the direction of travel in relation to the tip upper portion of the shell.

The invention also relates to a process for manufacturing the skiing boot.

In the known skiing boots comprising a shell and a shaft, the latter being composed of a collar and a cover, the collar is at the most linked to the shell jointly with the cover in the ankle region of the foot about an axis transverse to the direction of travel and is acted upon by a force acting opposed to the direction of travel by virtue of which the forward lean of the skier can be controlled. Because the axis of pivoting of the shaft not always coincides with the pivoting axis of the ankle due to individual anatomic details of the feet of the skiers, the foot is subjected during skiing and also during walking to pressures which guide the foot, exercised by the boot hinge regions onto the foot, whereby the natural movement of the foot is counteracted and the boot comfort is interfered with.

A skiing boot of the type referred to in the introduction has become known from AT-PS 339 771 in which the collar comprises a bending means in the form of a tongue which passes around a section of the shell, such that the collar can be adjusted slightly in the direction of travel in relation to the shell. In this construction lugs of the collar are guided in corresponding rebates of the shell portion, resulting in the disadvantage that moisture can enter the boot in that region.

OBJECTS AND GENERAL DESCRIPTION OF THE INVENTION

It is an object of the invention to provide means by which the lastmentioned drawback of known skiing boots is avoided and by which the forces transmitted by the boot to the foot and the guidance of the foot naturally brought about thereby are brought into harmony with the natural movement of the latter.

This is attainable in the context of a skiing boot of the type referred to above in that, in accordance with the invention, the connection between the structural unit and the tip upper portion of the shell is brought about by a resilient member which is manufactured as a single integral unit, e.g. by injection moulding, jointly with the two parts to be connected or which is on one side connected to that structural unit which comprises the collar and on the other side to the tip upper portion of the shell, e.g. by adhesive action. In a more specific embodiment the resilient part takes the form of a bellows.

Preferably the lower portion of the shell and the structural unit including one collar are in slidingly guided interengagement with one another, in which context preferably a groove is provided in one of the two parts and in the other a ridge or the like guided in the groove is provided.

According to a further feature of the invention, the cover is fitted on the heel side on both sides of the shell, pivotally about an axis transverse to the direction of motion and guided adjustably in the up and down direction by one slot and pin connection each. Preferably the structural unit comprising the collar is up and down adjustable in the sliding guide means.

The construction of the skiing boot in accordance with the invention offers the advantage that when skiing, the pressure of the shinbone onto the collar causes the structural unit comprising the latter to be moved forward with compression of the bellows or like resilient member and in the course thereof is enabled to move upwards about an axis in the lower part of the bellows, whereby the force acting onto the structural unit is dissipated into the front part of the shell whereby pressure regions which cause discomfort to the ankle joint region are avoided.

The process for manufacturing the skiing boot provides that at least the lower portions of the shell and the cover are manufactured from thermoplastic synthetic material containing a random fibre non-woven fabric. The term nonwoven fibre fabric is considered in principle to mean any fibre mixture which can be provided in the form of a random fibre web and which may for example be wound like wool. There may be provided a single whirl spun fibre, but it is also possible for an optional number of fibres to be embedded. The selection of fibres is at the option of the manufacturer. It is possible to employ glass, carbon and other fibres. This method of manufacturing offers the advantage that substantially lesser wall thicknesses of the boot parts can be attained during injection moulding without the minimum required rigidity of the sole and of the side walls dropping below acceptable standards. Moreover, a substantially better guidance of the skiing boot as was possible in known designs will be attained. Finally, the process according to the invention results in a rough surface of the skiing boot which is resistant to impact and stress.

BRIEF DESCRIPTION OF THE DRAWINGS

Further details of the invention will be explained further with reference to the drawing in which in FIG. 1 a working embodiment of the skiing boot according to the invention and in FIG. 2 a diagrammatic illustration of a press for manufacturing the lower part of the shell are illustrated.

DESCRIPTION OF SPECIFIC EMBODIMENTS

Figure 1:
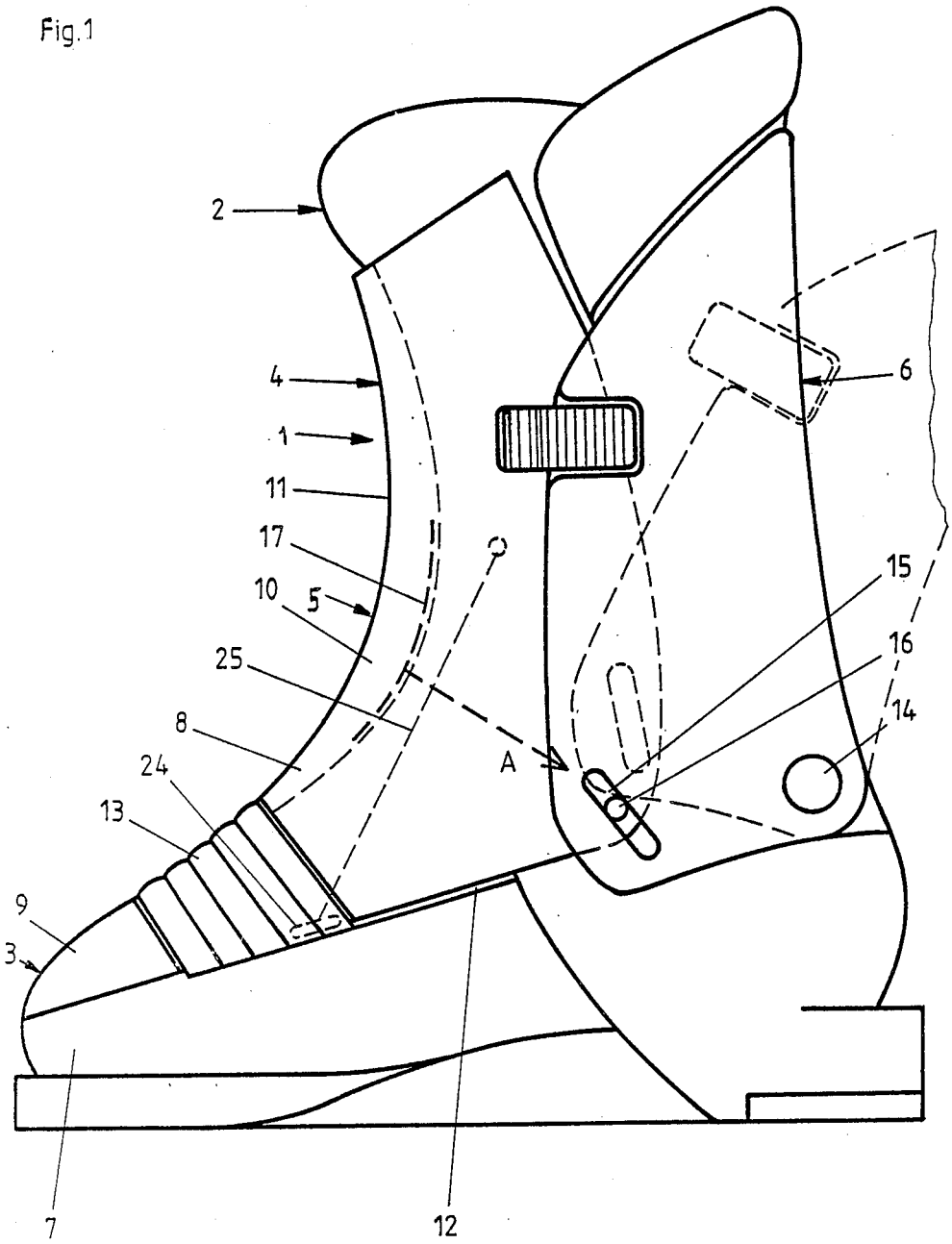

The following description which is by way of example should be read against the background of the above general description of the invention.

Referring now to the drawings, the skiing boot according to the invention comprises a boot upper portion 1 and an inner boot 2. The boot upper portion is composed of a shell 3 and a shaft 4 which in turn comprises a collar 5 and a cover or jet 6. The shell 3 comprises a lower shell 7 and an upper shell 8 comprising a tip portion 9 and an instep portion 10.

The tip portion 9 is in fixed relationship to the lower shell 7, whereas the instep portion 10 forms a single structural unit 11 with the collar 5, and is slidable in the direction of motion in relation to the lower shell 7 along a guide 12 extending downwardly towards the tip of the skiing boot and can be lifted to a minor extent in an upward direction. This guide can take the form of a sliding mechanism comprising a tongue and groove of which one part is associated with the lower shell 7 and the other with the structural unit 11. Between the structural unit 11 and the tip portion 9 a resilient connection is provided, in the present case a bellows 13, e.g. of rubber, which on one side is connected in sealing relationship to the tip portion 9 and on the other side to the structural unit 11.

The cover 6 is mounted pivotally on the heel side on both sides of the shell 3 about a pivot 14 and guided ahead of this close to its lower edge facing the structural unit 11 in relation to the shell 3 by a slot 15 passing from below in an upward direction and a pin 16 guided therein in a level adjustable manner.

Preferably a pressure blade 17 is provided between the inner boot 1 and the structural unit 11 which is connected by means of a traction cable with a tensioning device on the collar or another part of the skiing boot. This tensioning device transmits the force exercised onto the collar to the pressure plate 17 and vice versa. This traction cable can also be employed for closing the cover 6 after having entry into the skiing boot having taken place. In the open position of the cover 6 illustrated in broken lines, the bolt 16 is located outside the slot 15. The bolt may be kept under spring bias in a guide such that when the cover 6 is closed the bolt 16 will be displaced into that guide which may be provided in the cover or in the shell and will snap into the slot 15 in the closed position of the cover 6. The disengagement of the bolt 15 for stepping out of the boot can be brought about by means of a device which is operated from outside, e.g. by means of the tip of the skiing stick.

Figure 2:
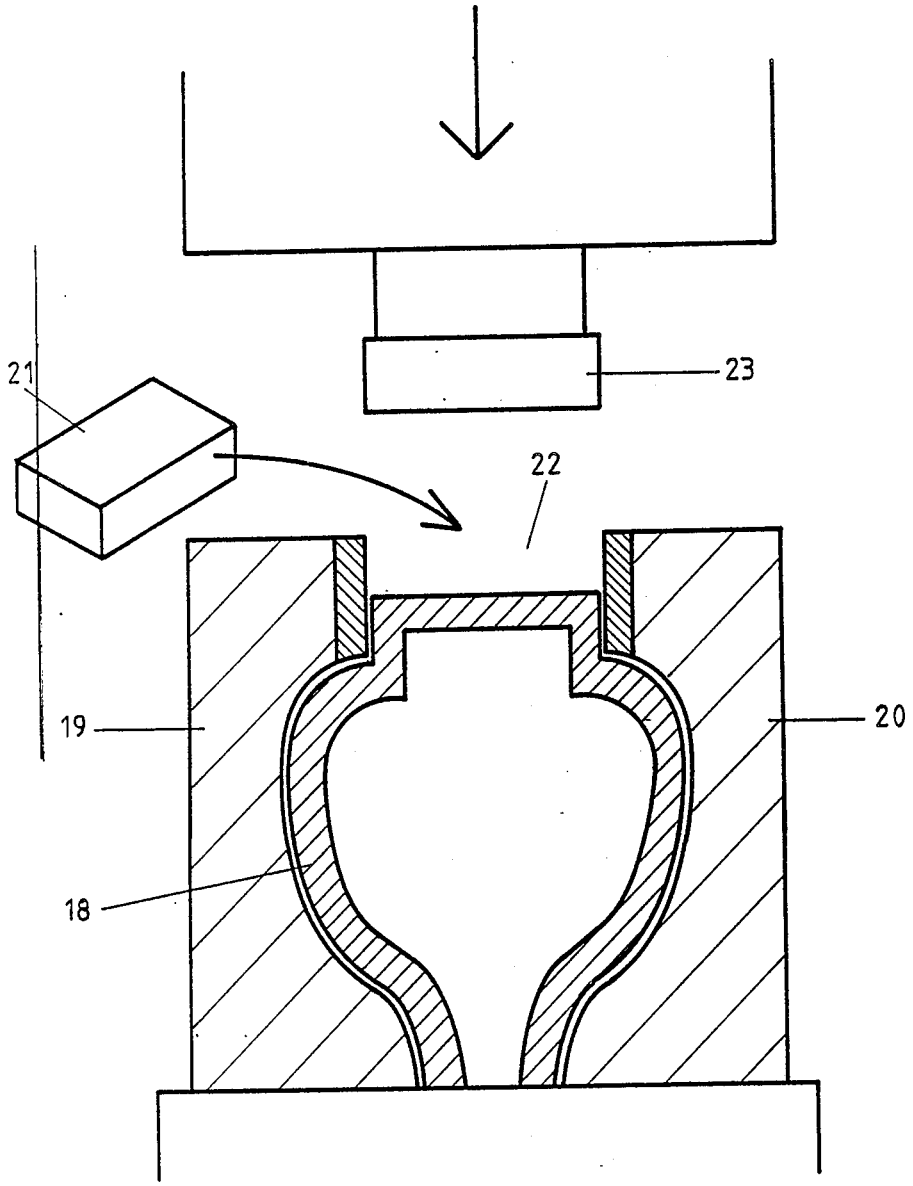

For manufacturing the skiing boot, a press is preferably used of which that portion is illustrated in FIG. 2 which is intended for the manufacture of the lower shell, optionally with the tip portion. In this context the boot last 18 serves as the male mould whilst two mould members 19, 20 are provided to serve as female moulds, and which in conjunction with the male mould confine the cavity for the manufacture of the respective boot part. The material used for that purpose which was described more specifically in the introduction is introduced in the form of a plate 21 into the aperture 22 and is pressed by means of a pressing die 23 with thermal action into the cavity between the male and female mould members.

It stands to reason that within the scope of the invention, various constructional modifications may be provided for. Thus it is possible, instead of the connection of the bellows or another resilient member to the structural unit or the tip portion, to provide a slide connection 24 accommodated in the lower shell 7 underneath the bellows 13 or the like and from where a link member 25, illustrated in broken lines, leads to the collar 5 or the structural unit 11 respectively.

The description of the specific examples, read with the general description of the invention will enable the skilled addressee to practise the invention as defined in the following claims.

What we claim is:

1. Skiing boot comprising a shell and a shaft which is composed of a cover adapted for entering the boot from behind, the cover being attached on opposite sides to a heel region of the shell by pivot means having an axis transverse to a longitudinal axis of the boot, and a collar forming a front portion of the shaft, the collar extending into an upper region of the shell and forming an integral structural unit with a portion of the shell upper region adjacent the collar, said unit being mounted for sliding movement on the shell in a lengthwise direction of travel in relation to a tip upper portion of the shell, wherein a connection between the structural unit and the tip upper portion of the shell comprises a resilient member in fixed connection on one side with the structural unit and on the other side with the tip upper portion of the shell, the resilient member being located forwardly of an instep region of the boot.

2. Skiing boot as claimed in claim 1, wherein the resilient member is manufactured as a single integral unit, jointly with the tip upper portion of the shell and said unit.

3. Skiing boot as claimed in claim 2, wherein the single integral unit is produced by injection moulding.

4. Skiing boot as claimed in claim 1, wherein the fixed connection is brought about by adhesive action.

5. Skiing boot according to claim 1, wherein the resilient portion takes the form of a bellows.

6. Skiing boot according to claim 1, wherein to faciliate said sliding movement, a groove is provided in one of the two parts consisting of the shell and said unit and a ridge or the like guided in the groove is provided in the other of the two parts.

7. Skiing boot according to claim 1, wherein the structural unit comprising the collar is adjustable up and down in relation to the shell.

8. Skiing boot according to claim 1, wherein the cover is guided adjustably in the up and down direction by a slot and pin connection on each side of the boot.

* * * * *